US010502473B2

(12) United States Patent
Jeong et al.

(10) Patent No.: US 10,502,473 B2
(45) Date of Patent: Dec. 10, 2019

(54) REFRIGERATOR

(71) Applicant: Samsung Electronics Co., Ltd., Suwon-si (KR)

(72) Inventors: Jin Jeong, Yongin-si (KR); Kyoung Ki Park, Suwon-si (KR); Bong Su Son, Cheonan-si (KR); Do Yun Jang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1008 days.

(21) Appl. No.: 14/991,310

(22) Filed: Jan. 8, 2016

(65) Prior Publication Data

US 2016/0201968 A1 Jul. 14, 2016

(30) Foreign Application Priority Data

Jan. 8, 2015 (KR) ..... 10-2015-0002890

(51) Int. Cl.

| | |
|---|---|
| ***F25C 5/18*** | (2018.01) |
| ***F25C 5/20*** | (2018.01) |
| ***F25D 3/06*** | (2006.01) |
| ***F25D 13/02*** | (2006.01) |
| ***F25D 13/04*** | (2006.01) |
| ***F25C 5/185*** | (2018.01) |

(Continued)

(52) U.S. Cl.

CPC ..... *F25C 5/24* (2018.01); *F25C 5/185* (2013.01); *F25C 5/22* (2018.01); *F25D 11/02* (2013.01); *F25D 23/025* (2013.01); *F25D 2323/021* (2013.01)

(58) Field of Classification Search

CPC ..... F25D 3/06; F25D 23/067; F25D 23/005; F25D 2303/081; F25D 2303/0822; F25D 2303/08221; F25D 23/021; F25D 25/025; F25D 3/04; F25D 13/02; F25C 5/18; F25C 5/182; F25C 5/20; F25C 5/22; F25C 5/24

USPC ..... 312/332.1

See application file for complete search history.

(56) References Cited

U.S. PATENT DOCUMENTS

| | | | |
|---|---|---|---|
| 4,087,140 | A | 5/1978 | Linstromberg |
| 2006/0260348 | A1 | 11/2006 | Martin et al. |

(Continued)

FOREIGN PATENT DOCUMENTS

| | | |
|---|---|---|
| CN | 101512259 | 8/2009 |
| CN | 103185431 | 7/2013 |

(Continued)

OTHER PUBLICATIONS

European Office Action for Appln. No. 16150585.4-1605 dated May 24, 2017.

(Continued)

*Primary Examiner* — Frantz F Jules
*Assistant Examiner* — Erik Mendoza-Wilkenfel
(74) *Attorney, Agent, or Firm* — Staas & Halsey LLP

(57) ABSTRACT

Disclosed herein is a refrigerator having a locker provided with a magnetic member to fix an ice bucket by use of magnetic attractive force and coupled to an upper wall of a body of the refrigerator. The ice bucket is removed by raising and then pulling it, while the locker is provided with an elastic guider to guide the removal of the ice bucket. The elastic guider is forced upward by the ice bucket during its removal and returns to its original position when the ice bucket is not forcing it upward.

19 Claims, 16 Drawing Sheets

(51) Int. Cl.
*F25D 11/02* (2006.01)
*F25D 23/02* (2006.01)

(56) References Cited

U.S. PATENT DOCUMENTS

| | | | | |
|---|---|---|---|---|
| 2010/0126204 | A1 | 5/2010 | Martin et al. | |
| 2012/0304684 | A1 | 12/2012 | Shaha et al. | |
| 2013/0174599 | A1* | 7/2013 | Jeong | F25C 5/182 62/344 |
| 2013/0192279 | A1* | 8/2013 | McCollough | F25D 21/08 62/66 |
| 2013/0263621 | A1* | 10/2013 | An | F25C 5/185 62/344 |

FOREIGN PATENT DOCUMENTS

| | | | |
|---|---|---|---|
| CN | 103363752 | | 10/2013 |
| EP | 1850078 | A2 | 10/2007 |
| EP | 1850078 | A3 | 1/2013 |
| EP | 2843326 | A2 | 3/2015 |
| KR | 10-0780836 | | 11/2007 |
| KR | 1020090133023 | | 12/2009 |
| KR | 10-2013-0114848 | | 10/2013 |
| KR | 10-2014-0137354 | | 12/2014 |
| KR | 10-2015-0026694 | | 3/2015 |
| WO | 2008/032986 | A1 | 3/2008 |

OTHER PUBLICATIONS

Chinese Decision on Grant, Appln No. 201610011911.3 dated Feb. 22, 2018 (6 pages).

Extended European Search Report for Appln. No. 16150585.4-1605 dated Jun. 27, 2016.

Korean Office Action dated Jun. 18, 2018 in corresponding Korean Patent Application No. KR 10-2015-0002890, 4 pgs.

Chinese Office Action, Appln No. 201610011911.3 dated Sep. 14, 2017 (9 pages).

Korean Office Action (Notice of Patent Allowance), dated Dec. 12, 2018 in corresponding Korean Patent Application No. 9-5-2018-085311250 (Total 3 pages).

* cited by examiner

REFRIGERATOR

RELATED APPLICATION(S)

This application claims the benefit of the Korean Patent Application No. 2015-0002890, filed on Jan. 8, 2015, in the Korean Intellectual Property Office, the disclosure of which is incorporated herein by reference.

BACKGROUND

Embodiments of the present disclosure relate to a refrigerator, and more particularly to an ice bucket fixing structure of a refrigerator having an ice-maker and an ice bucket.

In general, a refrigerator is an apparatus configured to keep food fresh. A refrigerator is provided with a storage compartment to store food and a cool air supplying apparatus to keep the refrigerator at an appropriate temperature, or appropriate temperatures if there is a refrigerator section and a freezer section.

The refrigerator may be provided with an ice-making tray to generate ice, and an ice bucket to store the ice generated at the ice-making tray. The ice-making tray may be inside of an ice-making compartment, and the ice bucket is removable from the ice-making compartment.

The ice bucket may have a fixing structure to fix (or keep in place) the ice bucket to the ice-making compartment. The fixing structure may be a latch structure as that shown in the U.S. Pat. No. 7,870,754.

The patent above describes the ice bucket fixed to the ice-making compartment by a latch and a catch when the ice bucket is inserted into the ice-making compartment. When the ice bucket is to be removed from the ice-making compartment, the latch needs to be moved to free it from the catch.

SUMMARY

It is an aspect of the present disclosure to provide a refrigerator having an ice bucket fixing structure configured to easily separate the ice bucket.

Various aspects of the disclosure will be set forth in the description that follows and various implementations may be made by practice of the disclosure.

In accordance with one aspect of the present disclosure, a refrigerator includes an ice-making compartment inside a body of the refrigerator, an ice-making tray configured to generate ice, where the ice-making tray is located inside the ice-making compartment. An ice bucket in the ice-making compartment is configured to store the ice, where the ice bucket is removable from the ice-making compartment. A stopper at a lower portion of the ice-making compartment is configured to restrain a horizontal movement of the ice bucket. A locker is coupled to an upper wall of the body, and includes an elastic guider, and a magnetic member to fix the ice bucket in place by use of magnetic force. The ice bucket may be raised to release it from the stopper so that the ice bucket can be removed from the ice-making compartment. The elastic guider may be pushed up by the ice bucket when the ice bucket is raised, and is not pushed up when the ice bucket is not raised and/or the ice bucket is not present in the ice-making compartment.

The locker includes a main supporting unit, which is inclinedly formed in an upward direction toward a front of the refrigerator, to receive the magnetic member, and the elastic guider extends from a lower end of the main supporting unit.

The elastic guider may include an auxiliary supporting unit, inclinedly formed in an upward direction toward a rear of the refrigerator, to support the magnetic member.

The elastic guider may also include a stopper unit to limit a rotational range of the elastic guider.

The locker may include an elastic holder unit to hold the magnetic member in the main supporting unit.

The locker may include an exit preventing unit at an upper side of the main supporting unit to keep the magnetic member in place in the main supporting unit.

A gap may be between the exit preventing unit and the magnetic member.

The elastic guider may be integrally formed with the locker.

The locker may include a slit around at least a portion of a perimeter of the elastic guider.

The stopper may be provided as to be elastically moved due to the ice bucket when the ice bucket is being removed.

In accordance with another aspect of the present disclosure, a refrigerator includes an ice-making compartment, having an opening, inside a body of the refrigerator. The refrigerator may include an ice-making tray inside the ice-making compartment, configured to generate ice, and an ice bucket configured to store the ice removably located in the ice-making compartment. The ice bucket may include a cover unit at a lower portion of the ice bucket and the cover unit may include a fixing protrusion. A stopper may be provided at a lower portion of the ice-making compartment, and the stopper may be configured to fix the ice bucket in place by coupling with the fixing protrusion. The stopper, when coupled to the fixing protrusion, may be configured to be moved from its original position by the fixing protrusion when the ice bucket is pulled and to return to its original position when the fixing protrusion is released from the stopper. The original position may also be referred to as the first position.

The stopper may be moved downward by the fixing protrusion to release the fixing protrusion.

The ice-making compartment includes a lower wall to which the stopper is coupled, and a movement gap between a front end portion of the lower wall of the ice-making compartment and the stopper.

The stopper may include a coupling unit coupled to the lower wall of the ice-making compartment, an interference unit configured to couple with the fixing protrusion, a guide unit at a front of the interference unit to guide the fixing protrusion to the interference unit, and a connection unit bendedly formed substantially in U-shape to connect the coupling unit to the interference unit.

The movement gap may be between the connection unit and the front end portion of the lower wall of the ice-making compartment.

The stopper may be configured to move toward a front of the refrigerator when the ice bucket is pulled.

The refrigerator may include an elastic member configured to move the stopper to the original position when the fixing protrusion no longer forces the stopper to move by releasing the stopper.

The elastic member may be, for example, a coil spring.

The interference unit may be inclinedly formed in an upward direction toward a front of the refrigerator.

An upper portion of the cover unit of the ice bucket may be provided with a first magnetic member, and the refrigerator comprises a locker with a second magnetic member that attracts the first magnetic member and is coupled to an upper wall of the body.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
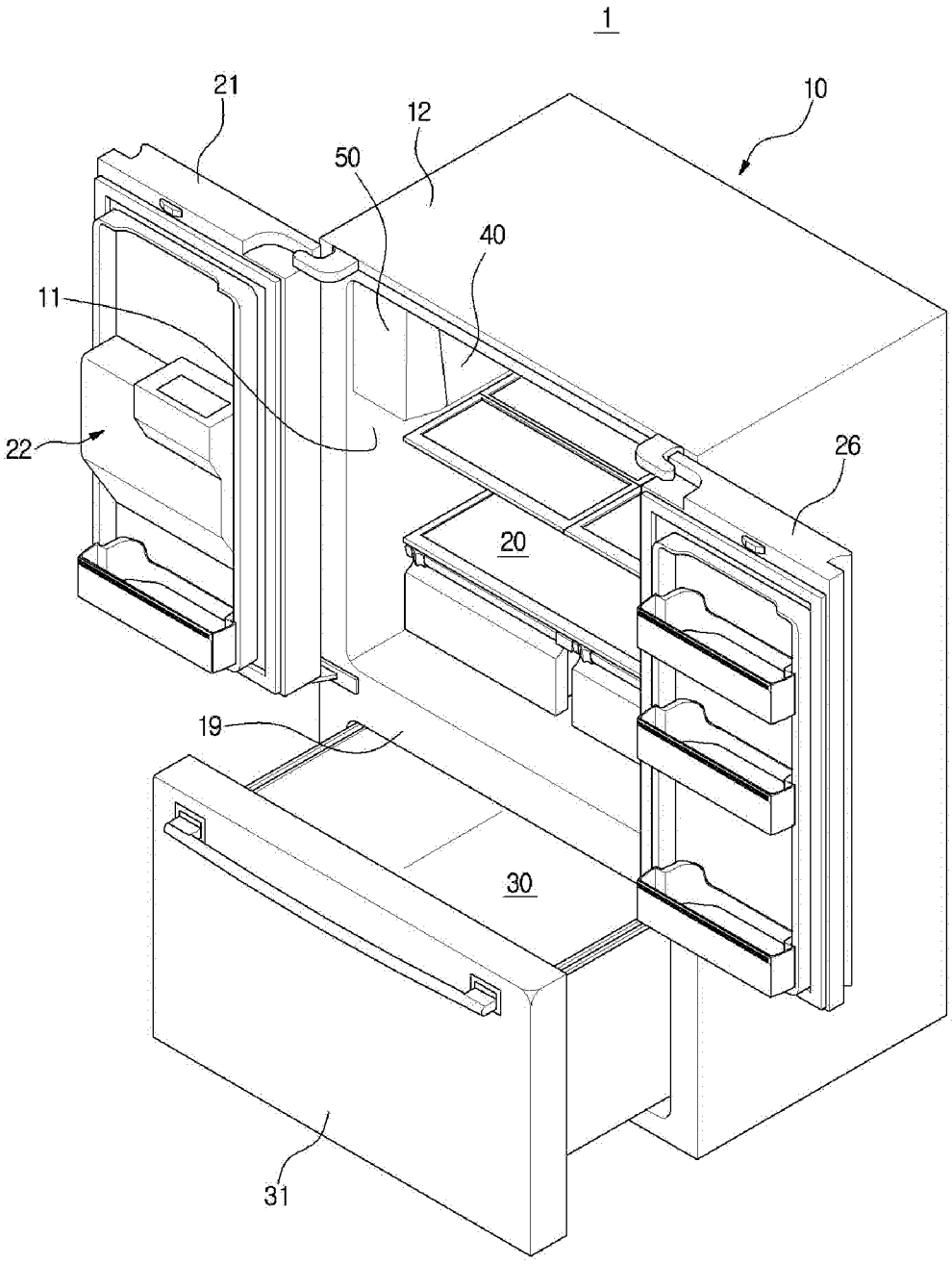
FIG. 1 is an exterior view of a refrigerator according to an embodiment of the present disclosure.

Reference will now be made in detail to some embodiments of the present disclosure, examples of which are illustrated in the accompanying drawings, wherein like reference numerals refer to like elements throughout.

In some embodiments of the present disclosure, "front" is the side of the refrigerator where a door is, and "rear" is the side opposite to the front. Also, in an embodiment of the present disclosure an ice bucket is inserted in to an ice-making compartment from the front toward the back, and removed by pulling the ice bucket toward the front.

Figure 2:
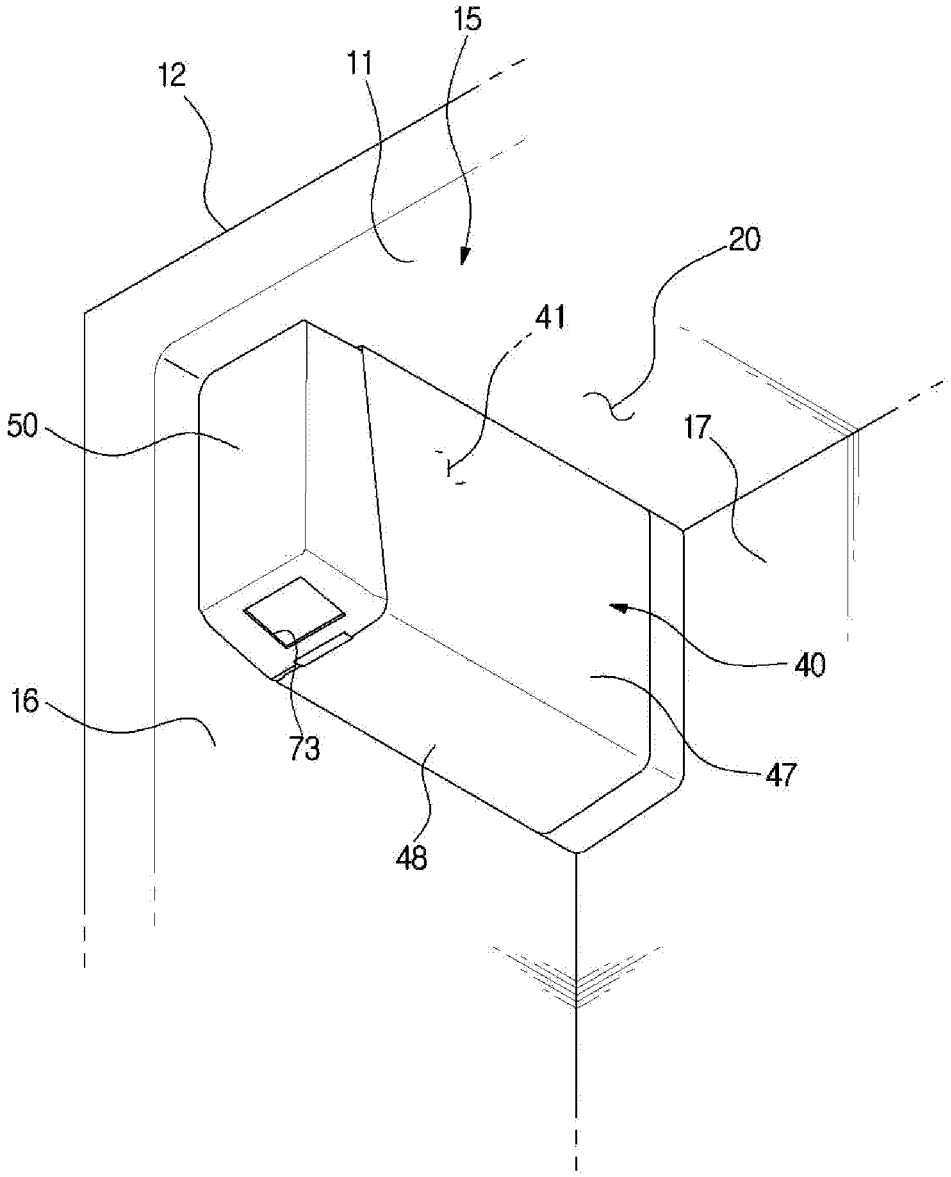
FIG. 2 is a lower portion perspective view illustrating an ice bucket of the refrigerator of FIG. 1 in an ice-making compartment.
Figure 3:
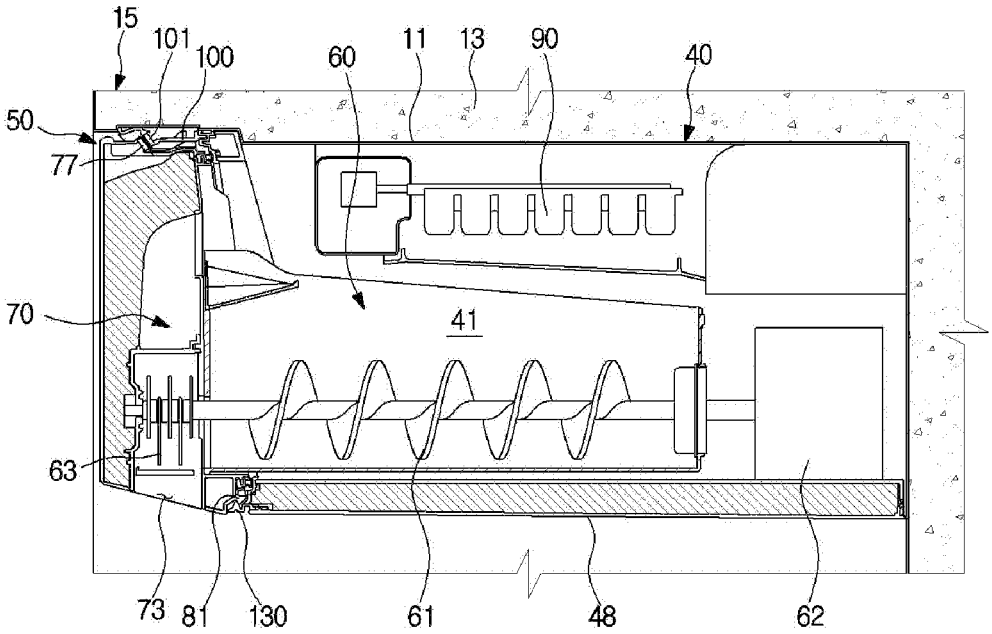
FIG. 3 is a cross-sectional view illustrating the ice bucket of the refrigerator of FIG. 1 in the ice-making compartment.
Figure 4:
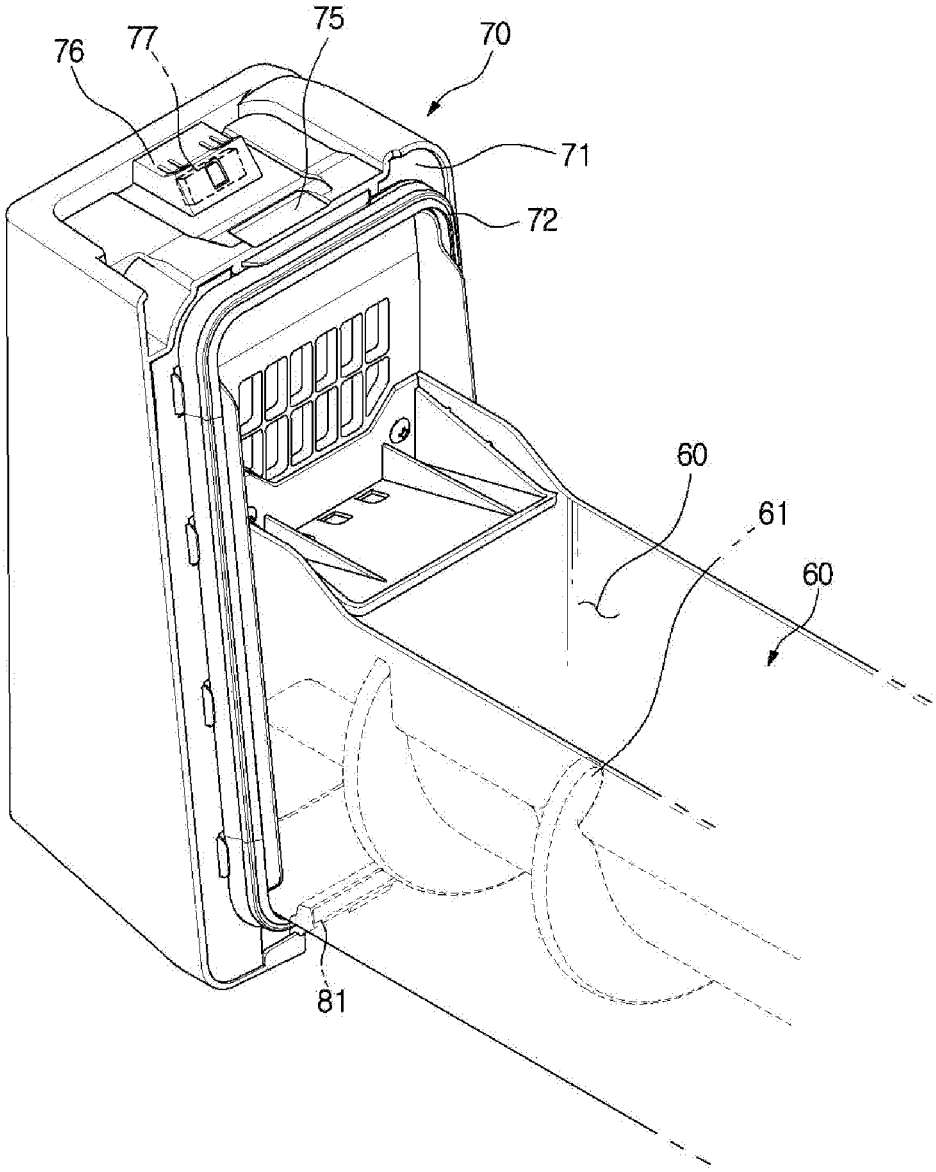
FIG. 4 is a drawing illustrating an extracted portion of the ice bucket of the refrigerator of FIG. 1.
Figure 5:
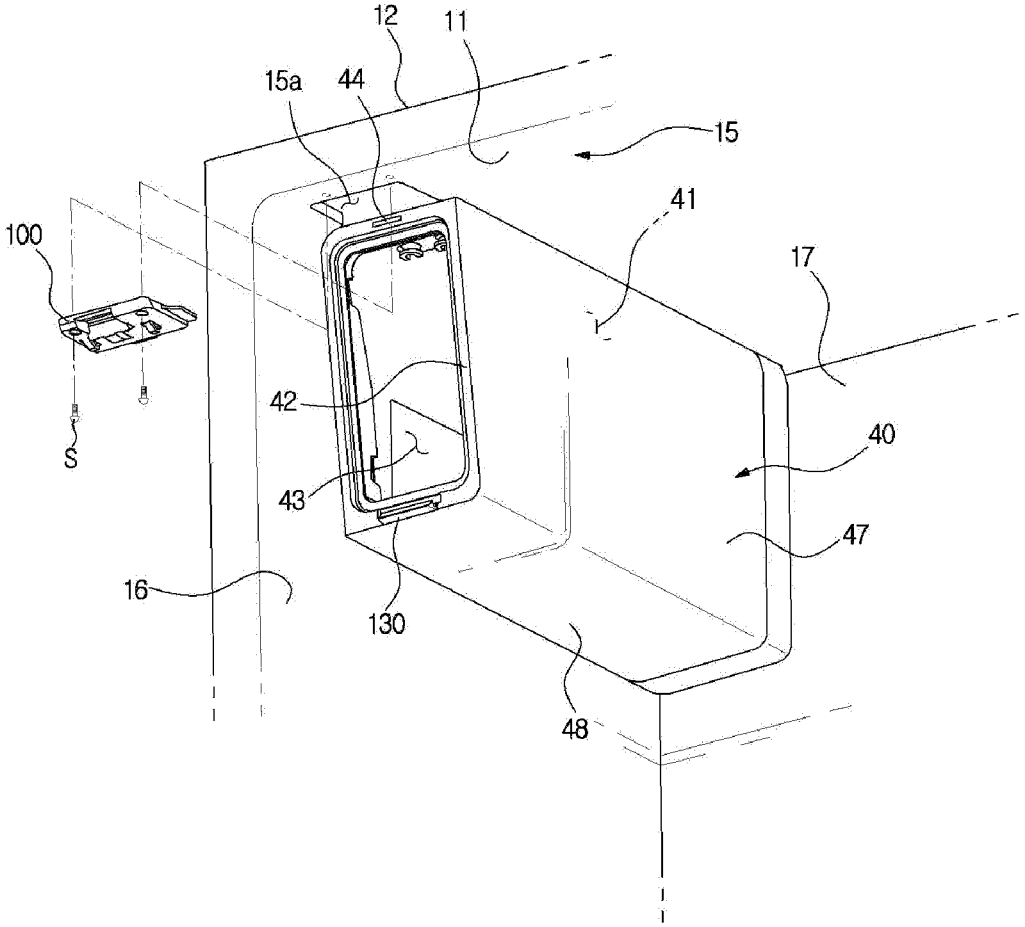
FIG. 5 is a drawing illustrating a locker of the refrigerator of FIG. 1 separated from an upper wall of a body.

FIG. 1 is a an exterior view of a refrigerator according to an embodiment of the present disclosure, FIG. 2 is a lower portion perspective view illustrating an ice bucket of the refrigerator of FIG. 1 in an ice-making compartment, FIG. 3 is a cross-sectional view illustrating the ice bucket of the refrigerator of FIG. 1 in the ice-making compartment, FIG. 4 is a drawing illustrating an extracted portion of the ice bucket of the refrigerator of FIG. 1, and FIG. 5 is a drawing illustrating a locker of the refrigerator of FIG. 1 separated from an upper wall of a body.

Referring to FIG. 1 to FIG. 5, a refrigerator 1 includes a body 10, a refrigerating compartment 20 and a freezing compartment 30 in the body 10, an ice-making compartment 40 at an upper portion of the refrigerating compartment 20, and a cool air supplying apparatus (not shown) to supply cool air to the refrigerating compartment 20 and the freezing compartment 30 and the ice-making compartment 40.

The body 10 includes an inner case 11 forming the refrigerating compartment 20 and the freezing compartment 30 and the ice-making compartment 40, an outer case 12 forming an exterior of the refrigerator 1 while coupled to an outer side of the inner case 11, and insulation material 13 to insulate the storage compartments 20 and 30 and the ice-making compartment 40 while provided in between the inner case 11 and the outer case 12.

From a different perspective, the body 10 is formed in the approximate shape of a box, and includes an upper wall 15, side walls 16, a rear wall 17, and a lower wall 18. The front may be open, but attached doors 21 and 26 close it off as well as provide access to the refrigerator compartment 20.

The refrigerating compartment 20 may be used to refrigerate food, and the freezing compartment 30 to freeze food. Some embodiments may have the freezing compartment 30 below the refrigerating compartment 20. The refrigerating compartment 20 and the freezing compartment 30 may be separated by a partition wall 19.

Access to the refrigerating compartment 20 may be via the doors 21 and 26 rotatively coupled to the body 10. The freezing compartment 30 may be open/closed by use of a sliding door 31 slidingly coupled to the body 10.

One door, for example, door 21, may be provided with a dispenser 22 to dispense ice generated in the ice-making compartment 40. A user may also use the dispenser 22 to obtain water. Accordingly, the water and ice may be obtained via the dispenser 22 without opening the door 21.

The ice-making compartment 40 may be provided, for example, at an upper corner of the refrigerating compartment 20. The ice-making compartment 40 may include an inside space 41, a front wall 42 of the ice-making compartment 40, a side wall 47 of the ice-making compartment 40, and a lower wall 48 of the ice-making compartment 40. The inside space 41 of the ice-making compartment 40 may be formed by the front wall 42 of the ice-making compartment 40, the side wall 47 of the ice-making compartment 40, the lower wall 48 of the ice-making compartment 40, the side wall 16 of the body, the upper wall 15 of the body, and the rear wall 17 of the body.

The front wall 42 of the ice-making compartment 40, the side wall 47 of the ice-making compartment 40, the lower wall 48 of the ice-making compartment 40 may be integrally formed. Inside each of the front wall 42 of the ice-making compartment 40, the side wall 47 of the ice-making compartment 40, and the lower wall 48 of the ice-making compartment 40 may be insulation material to insulate the ice-making compartment 40 from the rest of the refrigerating compartment 20. The front wall 42 of the ice-making compartment 40, the side wall 47 of the ice-making compartment 40, the lower wall 48 of the ice-making compartment 40 may be separate from the inner case 11 of the body, and may need to be coupled to the inner case 11.

The front wall 42 of the ice-making compartment 40 may be provided with an opening 43 such that an ice bucket 50 may be inserted into or withdrawn from the inside space 41 of the ice-making compartment 40. In addition, a lower end of the front wall 42 of the ice-making compartment 40 may be provided with a stopper 130 configured to stop the ice bucket 50 from moving forward more.

The inside space 41 of the ice-making compartment 40 may be provided with an ice-making tray 90 configured to generate ice. The ice-making tray 90 may be cooled by use of a direct cooling method or an indirect cooling method.

The ice bucket 50 includes an ice storage unit 60 to store the ice generated by the ice-making tray 90, and a cover unit 70 to cover the opening 43 of the ice-making compartment 40.

The ice storage unit 60 is designed to pass through the opening 43 of the ice-making compartment 40, and is provided with an open upper surface such that it can receive ice from the ice-making tray 90. Inside of the ice storage unit 60 may be an auger 61 to deliver ice to the front so that it may be dispensed by the dispenser 22. A rear of the ice bucket 50 may be provided with an auger motor 62 configured to drive the auger 61.

The cover unit 70 may be larger than the opening 43 of the ice-making compartment 40, and configured to seal the opening 43 of the ice-making compartment 40 while disposed outside of the ice-making compartment 40. The cover unit 70 may be provided with a sealing member 72, which may be made of, for example, rubber material, to help maintain a seal with the front wall 42 of the ice-making compartment 40. The sealing member 72 may be formed in the approximate shape of a rectangle along the borders of the opening 43.

Inside of the cover unit 70 may be a crushing apparatus 63 to crush the ice delivered by the auger 61. The crushed ice may be dispensed via an outlet 73 to the dispenser 22.

A lower end of the bottom surface 71 of the cover unit 70 may be provided with a fixing protrusion 81 capable of latching with the stopper 130 to keep the ice bucket 50 fixed at its position in the ice-making compartment 40.

The fixing protrusion 81 provided at a lower end of the ice bucket 50 and the stopper 130 provided at a lower end of the ice-making compartment 40 may couple with each other to fix the lower end of the ice bucket 50, and first magnetic member 77 and second magnetic member 101, which will be described later, are provided to fix the upper end of the ice bucket 50.

The fixing protrusion 81 of the ice bucket 50 and the stopper 130 of the ice-making compartment 40 are coupled to restrain horizontal movements of the ice bucket 50 inserted into the ice-making compartment 40. Therefore, to pull out the ice bucket 50 from the ice-making compartment 40, the fixing protrusion 81 must be released from the stopper 130 by, for example, raising the ice bucket 50.

An upper end unit 75 of the cover unit 70 may be provided with a first magnetic member 77 and the upper wall 15 of the body may be provided with a second magnetic member 101, The first magnetic member 77 and the second magnetic member 101 may couple to each other to help fix the ice bucket 50 when it is inserted into the ice-making compartment 40.

The first magnetic member 77 and the second magnetic member 101 may be permanent magnets such as, for example, neodymium magnets, ferrite magnets, or alnico magnets.

Alternatively, there may be a magnet on one of the two parts (the cover unit 70 or the upper wall 15), and there may be metal that may be attracted to the magnet in a corresponding area of the other of the two parts. For example, the cover unit 70 may comprise the first magnetic member 77 and the upper wall 15 may comprise a metal part that will couple to the first magnetic member 77, or vice versa.

The first magnetic member 77 and the second magnetic member 101 each may be formed in the approximate shape of a cuboid, or other shape as appropriate.

The upper end unit 75 of the cover unit 70 is provided a magnetic substance mounting unit 76 to which the first magnetic member 77 is mounted. The magnetic substance mounting unit 76 may be in the shape of a groove, for example, and the first magnetic member 77 may be fixed to the magnetic substance mounting unit 76.

The upper wall 15 of the body may be provided with a locker 100 that has the second magnetic member 101. The upper wall 15 of the body may be provided with a locker mounting unit 15*a* (FIG. 5) that may be concavely formed such that the locker 100 may be coupled to the upper wall 15. The locker 100 may be coupled to the upper wall 15 via a fastening member S such as, for example, a screw, a bolt, rivet, or a pin.

Figure 6:
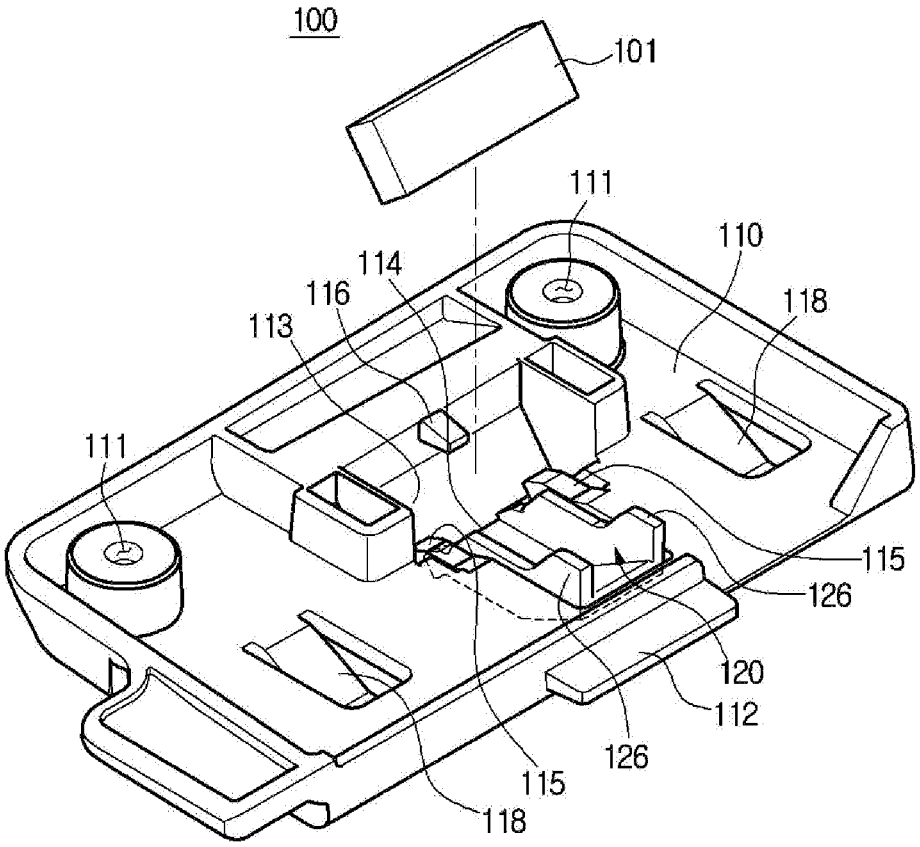
FIG. 6 is a perspective view illustrating the locker of the refrigerator of FIG. 1.
Figure 7:
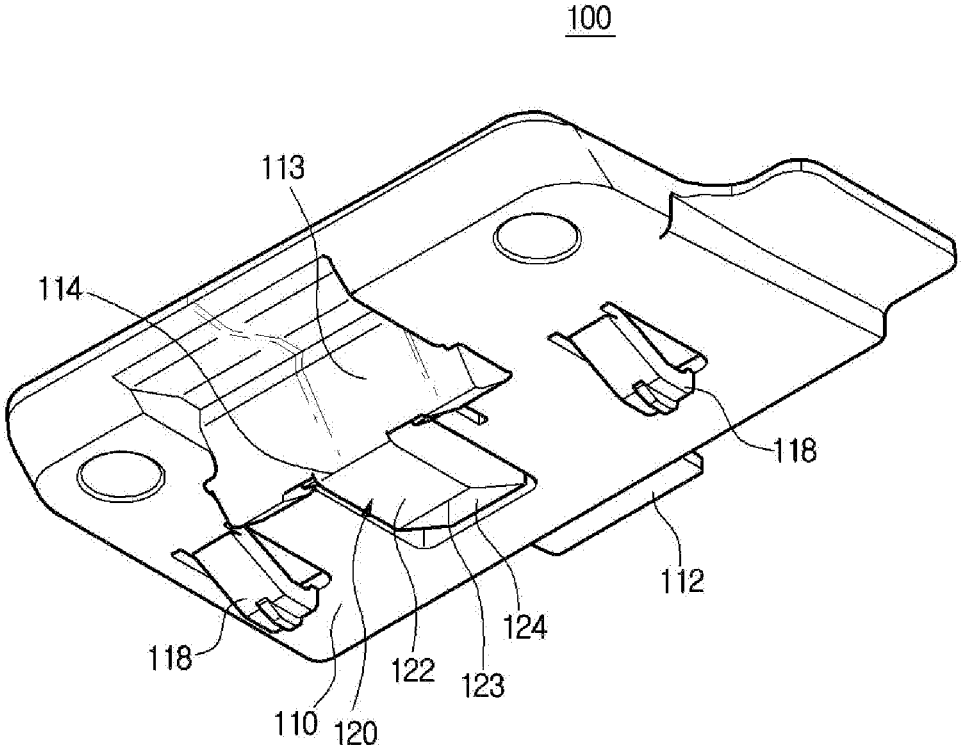
FIG. 7 is a bottom view of the locker of the refrigerator of FIG. 1.
Figure 8:
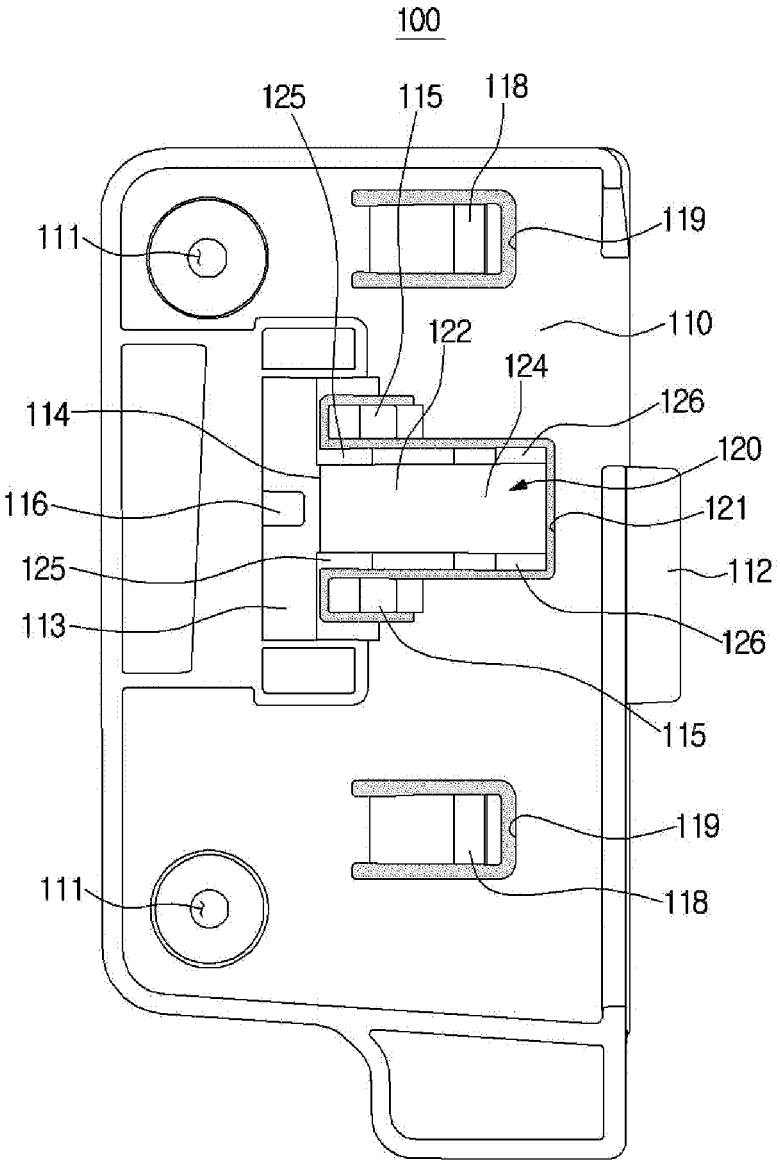
FIG. 8 is a plan view illustrating the locker of the refrigerator of FIG. 1.
Figure 9:
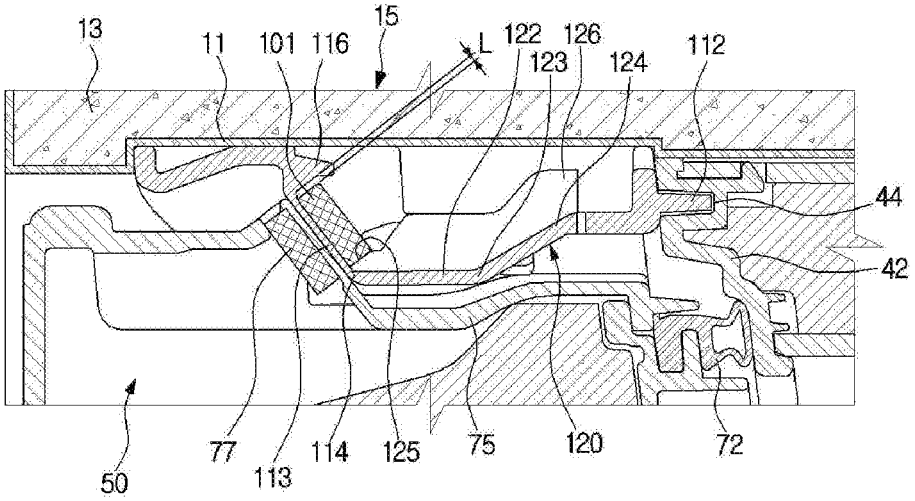
FIG. 9 is a cross-sectional view illustrating an elastic guider of the locker when the ice bucket of the refrigerator of FIG. 1 is in the ice-making compartment.
Figure 10:
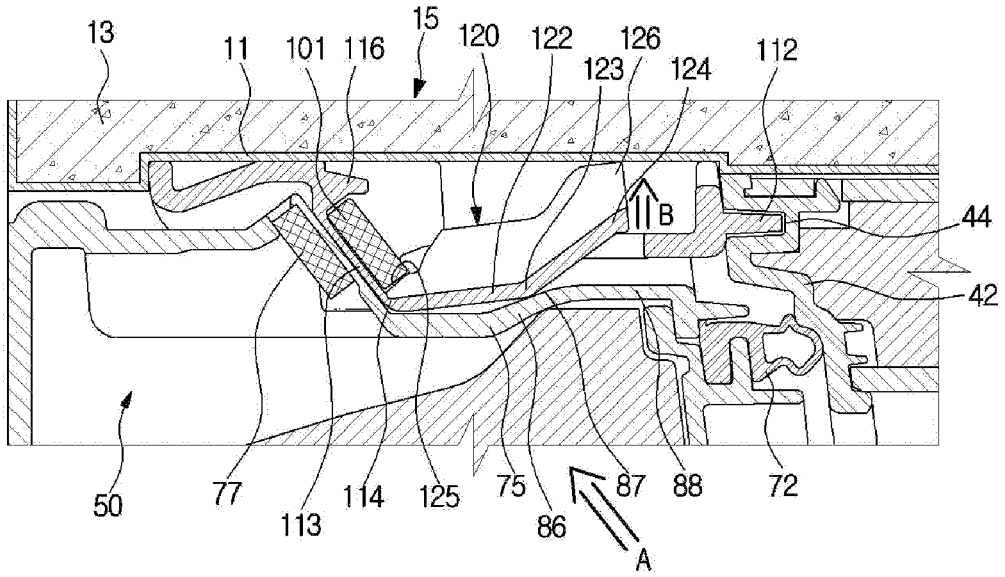
FIGS. 10 to 12 are cross-sectional views describing motions of the elastic guider when the ice bucket of the refrigerator of FIG. 1 is being removed from the ice-making compartment.
Figure 11:
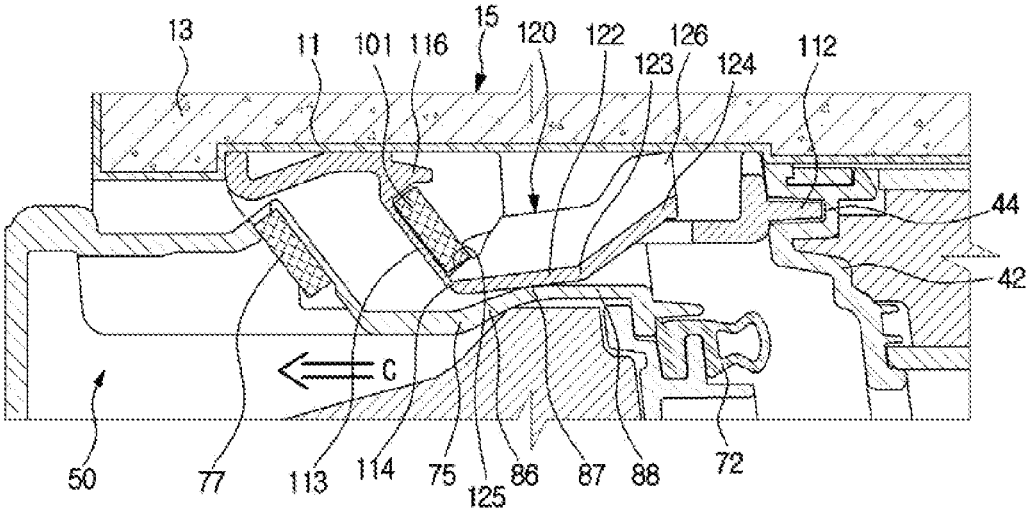
Figure 12:
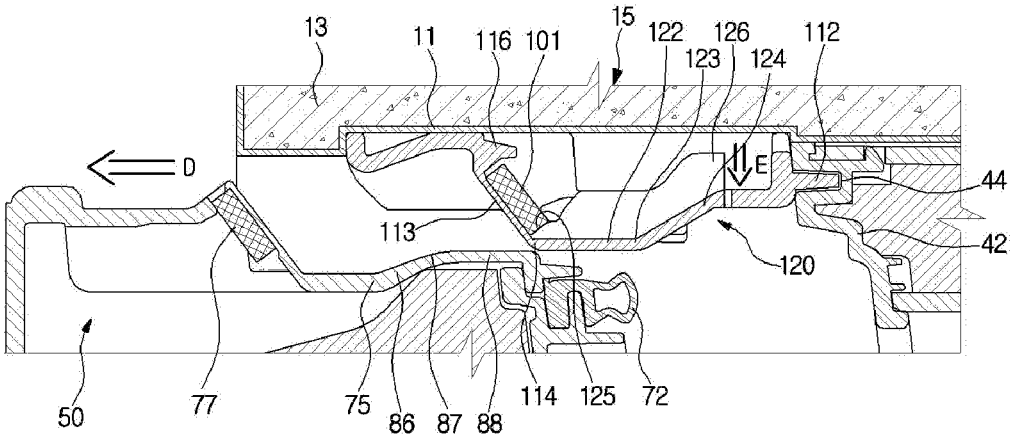

FIG. 6 is a perspective view illustrating the locker of the refrigerator of FIG. 1, FIG. 7 is a bottom view of the locker of the refrigerator of FIG. 1, FIG. 8 is a plan view illustrating the locker of the refrigerator of FIG. 1, FIG. 9 is a cross-sectional view of an elastic guider of the locker when the ice bucket of the refrigerator of FIG. 1 is in the ice-making compartment 40, and FIG. 10, FIG. 11 and FIG. 12 are cross-sectional views describing motions of the elastic guider when the ice bucket of the refrigerator of FIG. 1 being removed from the ice-making compartment 40.

Referring to FIG. 6 to FIG. 12, the locker 100 includes the second magnetic member 101 mounted in the locker body 110. The locker body 110 may be a single unit, and may be formed through an injection-molding method without the need for an assembly process.

The locker 100 includes a main supporting unit 113 in which the second magnetic member 101 may be placed and supported. The main supporting unit 113 may be formed to incline upward toward the front when the locker 100 is coupled to the upper wall 15. As the main supporting unit 113 is inclined, the second magnetic member 101 placed at the main supporting unit 113 may also be inclined.

The locker 100 may include an elastic holder unit 115 configured to hold the second magnetic member 101 in the main supporting unit 113. The elastic holder unit 115 may be flexible, and may be bent to allow placement of the second magnetic member 101 in the main supporting unit 113. When the second magnetic member 101 is in place, the elastic holder unit 115 may then press against the second magnetic member 101 to keep it in place in the main supporting unit 113.

The locker 100 may include an exit preventing unit 116 at an upper side of the main supporting unit 113 that serves to keep the second magnetic member 101 from slipping out of the main supporting unit 113.

The locker 100 may include a fastening hole 111 to couple the locker 100 to the upper wall 15, and an insertion protrusion 112 to insert in to an insertion groove 44 of the front wall 42 of the ice-making compartment 40. The insertion protrusion 112 may be provided to protrude toward the ice-making compartment 40 from the locker body 110. The insertion protrusion 112 and the insertion groove 44 may be used to align the locker 100 with the upper wall 15.

The locker 100 may include an elastic fixing unit 118 configured to help the ice bucket 50 by pressing against the top of the front portion of the ice bucket 50 when the ice bucket 50 is inserted into the ice-making compartment 40. A slit 119 (FIG. 8) may be formed between the elastic fixing unit 118 and the locker body 110 such that the elastic fixing unit 118 may move more easily.

As described previously, when the ice bucket 50 is to be pulled out, the fixing protrusion 81 must first be released from the stopper 130 by raising the ice bucket 50.

The locker 100 includes an elastic guider 120 that may need to be moved out of the way to remove the ice bucket 50. When the ice bucket 50 is raised, the elastic guider 120 is forced up. When the ice bucket 50 has been removed or the ice bucket 50 is not raised, the elastic guider 120 returns to its normal position.

That is, the elastic guider 120 is a portion of the locker body 110 pressed by the ice bucket 50 when it is raised, and is moved up so as not to get in the way of the ice bucket 50 so that the ice bucket 50 may be easily withdrawn.

A slit 121 (FIG. 8) may be formed along at least a portion of the perimeter of the locker body 110 and the elastic guider 120 so that the elastic guider 120 may move more easily.

From a different perspective, the elastic guider 120 is a portion that may be difficult to economically or technically omit considering the structure of a mold at the time of injection-molding the locker body 110. By forming the slit 121 around the elastic guider 120, the elastic guider 120 can be moved out of the way when raising the ice bucket 50 so that the ice bucket 50 may be removed.

The elastic guider 120 extends from a lower end 114 of the main supporting unit 113. Therefore, the elastic guider 120 may flex about the lower end 114 of the main supporting unit 113. The elastic guider 120 may comprise a first extension unit 122 extended from the main supporting unit 113 toward the ice-making compartment 40, a second extension unit 124 inclinedly extended from the first extension unit 122, and a bending unit 123 where the first extension unit 122 meets the second extension unit 124.

The elastic guider 120 may be provided with an auxiliary supporting unit 125 to support the second magnetic member 101. The auxiliary supporting unit 125 may be inclinedly formed toward an opposite direction with respect to the main supporting unit 113, That is, the auxiliary supporting unit 125 may be inclinedly formed in an upward direction toward the rear.

The second magnetic member 101 may move a little bit according to the movement of the elastic guider 120, as the second magnetic member 101 is supported at the auxiliary supporting unit 125 of the elastic guider 120.

That is, when the elastic guider 120 is moved up, the second magnetic member 101 may also move up a bit, and when the elastic guider 120 moves down, the second magnetic member 101 also moves down to its normal position. Therefore, a marginal gap L (FIG. 9) through which the second magnetic member 101 may move may be between the exit preventing unit 116 and the second magnetic member 101.

The elastic guider 120 may be provided with a stopper unit 126 on top of it to limit the moving range of the elastic guider 120. The stopper unit 126 may limit the movement of the elastic guider 120 by making contact with the upper wall 15 of the body when the elastic guider 120 moves by more than a predetermined distance.

Hereinafter, the movements of the elastic guider 120 in a process of withdrawing the ice bucket 50 will be described.

As illustrated on FIG. 3 and FIG. 9, when the ice bucket 50 is in the ice-making compartment 40, a lower portion of the ice bucket 50 is held in place by the fixing protrusion 81 and the stopper 130, and an upper portion of the ice bucket 50 may be held in place by the first magnetic member 77 and the second magnetic member 101.

The elastic guider 120 of the locker 100 is in an initial state of being spaced apart from the upper end unit 75 of the ice bucket 50.

As illustrated on FIG. 10, when the ice bucket 50 is raised in direction A to release the fixing protrusion 81 from the stopper 130, the elastic guider 120 is pressed by the upper end unit 75 of the ice bucket 50, and accordingly, the elastic guider 120 may be moved in direction B. When raising the ice bucket 50 in direction A, the ice bucket 50 needs to be raised by a larger force than the magnetic force of the first magnetic member 77 and the second magnetic member 101.

In detail, the upper end unit 75 of the ice bucket 50 is provided with an inclination unit 86 inclinedly formed in an upward direction toward the rear, a plane unit 88 horizontally extended at the inclination unit 86, and a curved unit 87 formed in between the inclination unit 86 and the plane unit 88. Accordingly, when the ice bucket 50 is raised toward direction A, the inclination unit 86 of the upper end unit of the ice bucket 50 or the curved unit 87 may press the bending unit 123 of the elastic guider 120.

The elastic guider 120 may move up until the stopper unit 126 reaches the upper wall 15.

Accordingly, when the ice bucket 50 is raised, the elastic guider 120 is moved up out of the way, and the movement of the ice bucket 50 is not blocked.

After releasing the fixing protrusion 81 from the stopper 130 by raising the ice bucket 50, when the ice bucket 50 is pulled out in direction C as illustrated on FIG. 11, the ice bucket 50 may be withdrawn.

The first extension unit 122 of the elastic guider 120 may guide the curved unit 87 of the upper end unit of the ice bucket 50 toward the front.

As illustrated on FIG. 12, as the withdrawal of the ice bucket 50 is completed by pulling the ice bucket in direction D, the elastic guider 120 may drop down to its original position by moving in direction E.

Figure 13:
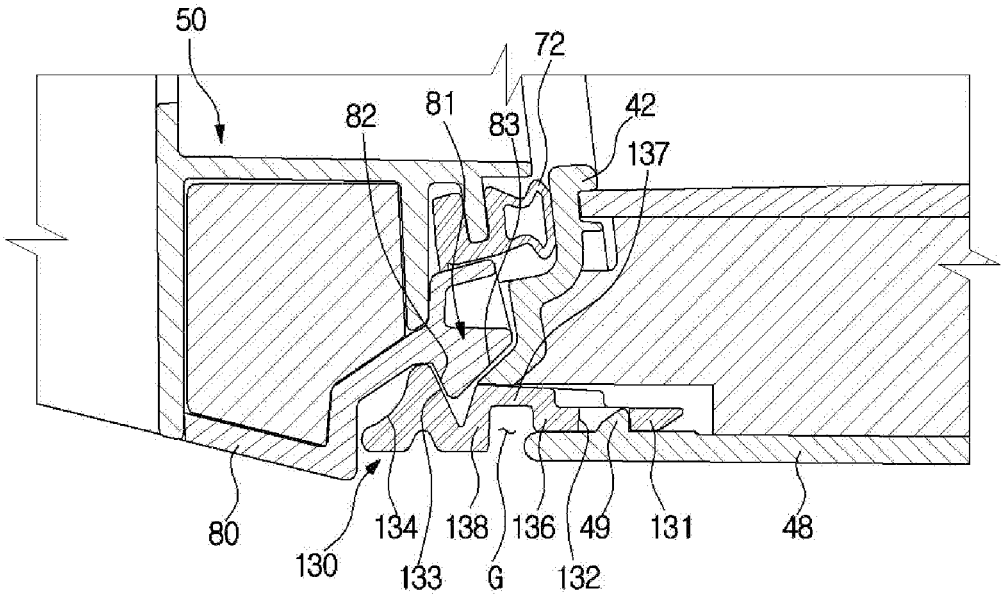
FIG. 13 is a cross-sectional view illustrating a lower portion fixing structure of an ice bucket of a refrigerator according to an embodiment of the present disclosure.
Figure 14:
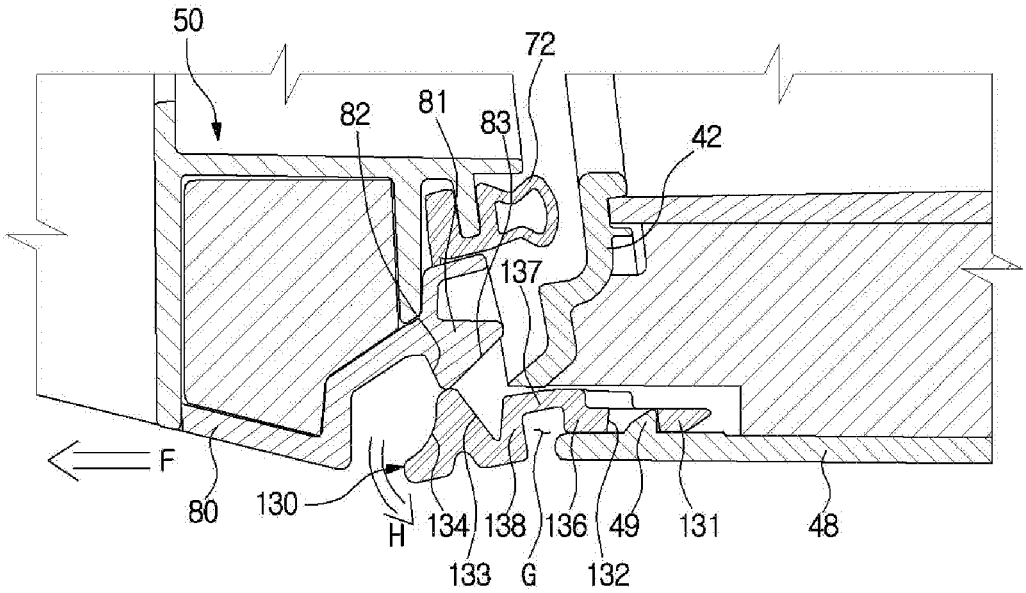
FIG. 14 is a drawing describing a motion of a stopper when the ice bucket of the refrigerator of FIG. 13 being removed.

FIG. 13 is a cross-sectional view illustrating a lower portion fixing structure of an ice bucket of a refrigerator according to a second embodiment of the present disclosure, and FIG. 14 is a drawing describing a motion of a stopper when the ice bucket of the refrigerator of FIG. 13 being removed.

Referring to FIG. 13 and FIG. 14, the lower portion fixing structure of the ice bucket of the refrigerator according to the second embodiment of the present disclosure will be described. Components that are identical those in the embodiments described above will not be described again.

As described, when the fixing protrusion 81 is coupled to the stopper 130 in the first embodiment, horizontal movement of the ice bucket 50 is restrained. To remove the ice bucket 50, the ice bucket 50 needs to be raised to uncouple the fixing protrusion 81 from the stopper 130.

The second embodiment describes a structure configured to remove the ice bucket 50 by raising the ice bucket 50 rather slightly in comparison to the already-described embodiment above, or by pulling the ice bucket 50 without raising the ice bucket 50.

The fixing protrusion 81 of the ice bucket 50 may be integrally formed with a bottom unit 80 of the cover unit 70 of the ice bucket 50. The fixing protrusion 81 is provided with a hook unit 82 that may latch the stopper 130, and a slide unit 83 may guide the stopper 130 to the hook unit 82 when the ice bucket 50 is inserted in to the ice-making compartment 40. The hook unit 82 is inclinedly formed in an upward direction toward the rear, and the slide unit 83 may be inclinedly formed in an upward direction toward the front.

The stopper 130 may be coupled to the lower wall 48 of the ice-making compartment 40. The stopper 130 may include a coupling unit 131 coupled to the lower wall 48 of the ice-making compartment, an interference unit 133 to latch with the hook unit 82 of the fixing protrusion 81, a guide unit 134 to guide the hook unit 82 of the fixing protrusion 81 to the interference unit 133, and connection units 136, 137, and 138 to connect the coupling unit 131 and the interference unit 133.

The coupling unit 131 is provided with a coupling groove 132, and the lower wall 48 of the ice-making compartment 40 may be provided with a coupling protrusion 49 insertedly coupled to the coupling groove 132.

The interference unit 133 may be inclinedly formed in an upward direction toward the front, and the guide unit 134 may be inclinedly formed in an upward direction toward the rear. Therefore, the hook unit 82 of the fixing protrusion 81 may release from the interference unit 133 of the stopper 130 as they slide apart when the ice bucket 50 is pulled.

The connection units 136, 137, and 138 may be formed to be substantially in the shape of a letter "U."

A movement gap G may be formed in between the stopper 130 and a front end portion of the lower wall 48 of the ice-making compartment so that the stopper 130 may be moved. In detail, the movement gap G may be formed between the connection unit 136, 137, and 138 of the stopper 130 and the front end portion of the lower wall 48 of the ice-making compartment.

The movement gap G is provided to release the fixing protrusion 81 from the stopper 130 by having the stopper 130 move downward when the ice bucket 50 is pulled. That is, when the ice bucket 50 is pulled in direction F, the stopper 130 is pressed by the fixing protrusion 81, and the stopper 130 may move in a direction H toward the movement gap G. Since the stopper 130 is formed of elastic material, it may return to its original position when the fixing protrusion 81 has moved by the stopper 130.

By use of the structure described above, the ice bucket 50 may be removed by simply pulling on the ice bucket 50 without raising the ice bucket 50.

Figure 15:
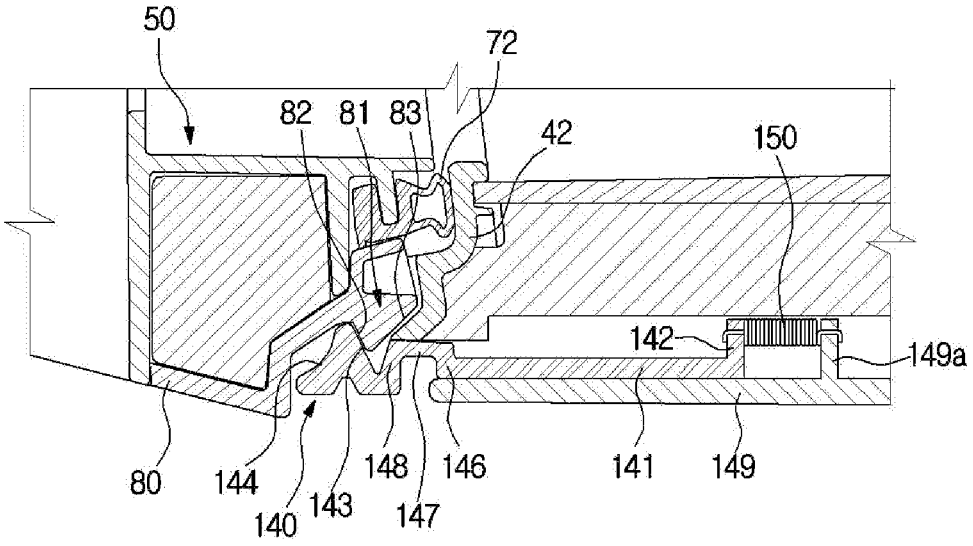
FIG. 15 is a cross-sectional view illustrating a lower portion fixing structure of an ice bucket of a refrigerator according to an embodiment of the present disclosure.
Figure 16:
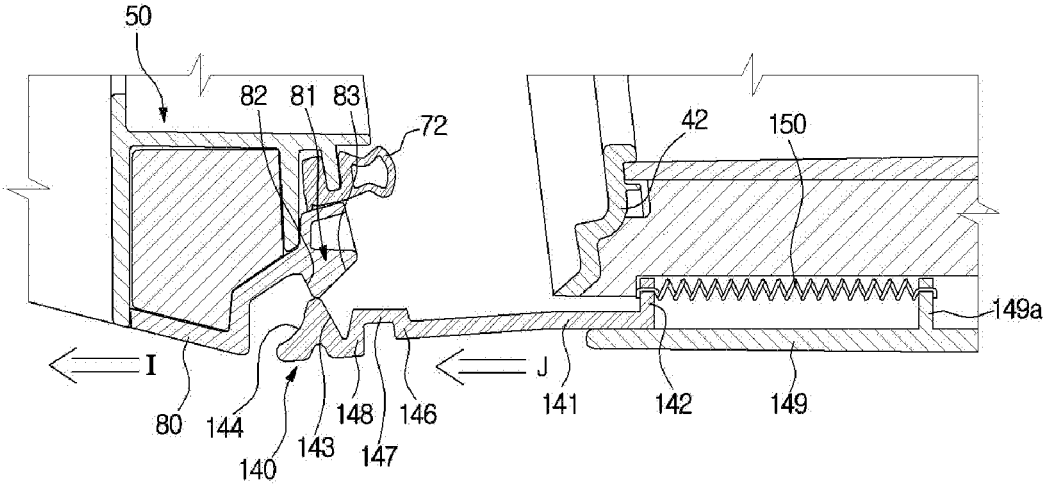
FIG. 16 is a drawing describing motion of a stopper when the ice bucket of the refrigerator of FIG. 15 being removed.

FIG. 15 is a cross-sectional view illustrating a lower portion fixing structure of an ice bucket of a refrigerator according to a third embodiment of the present disclosure, and FIG. 16 is a drawing describing a motion of a stopper when the ice bucket of the refrigerator of FIG. 15 is being removed.

Referring to FIG. 15 and FIG. 16, the lower portion fixing structure of the ice bucket of the refrigerator according to the third embodiment of the present disclosure will be described. Components that are identical to those already described will not be described again.

The lower fixing structure of the third embodiment is a structure configured to enable removing the ice bucket 50 by raising the ice bucket 50 rather slightly in comparison to the already-described embodiments, or by pulling the ice bucket 50 without raising the ice bucket 50 when removing the ice bucket 50.

The fixing protrusion 81 of the ice bucket 50 is identical to the already-described second embodiment, and therefore its description will be omitted.

A stopper 140 may be coupled to a lower wall 149 of the ice-making compartment. The stopper 140 may include a coupling unit 141 movably coupled to the lower wall 149 of the ice-making compartment, an interference unit 143 that couples with the hook unit 82 of the fixing protrusion 81, a guide unit 144 to guide the hook unit 82 of the fixing protrusion 81 to the interference unit 143 when inserting the ice bucket 50, and connection units 146, 147, and 148 to connect the coupling unit 141 and the interference unit 143.

The coupling unit 141 is extended lengthwise in front/rear directions, and may be supported by the lower wall 149 of the ice-making compartment 40 when the ice bucket 50 is inserted. However, the stopper 140 is moved along the ice bucket 50 toward the front as the ice bucket 50 is pulled, and as a result, a portion of the coupling unit 141 may not be supported by the lower wall 149 of the ice-making compartment 40. This may allow the stopper 140 to bend down, and therefore release the hook unit 82 of the fixing protrusion 81, Accordingly, the ice bucket 50 may be removed.

In more detail, the interference unit 143 may be inclinedly formed in an upward direction toward the front, and the guide unit 144 may be inclinedly formed in an upward direction toward the rear. The connection units 146, 147, and 148 each may be bendedly formed, for example, to be provided substantially with the shape of a letter "U."

The stopper 140, in its original position, or a "first position," moves with the ice bucket 50 toward the front in direction J along the ice bucket 50 due to the fixing protrusion 81 when the ice bucket 50 is pulled toward the front in direction I. When the fixing protrusion 81 separates from the stopper 140 the stopper 140 is returned to its original position.

An elastic member 150 may be used to return the stopper 140 to its original position. The elastic member 150 may be, for example, a coil spring. However, other elastic members such as, for example, an elastic string or a rubber band having elasticity may be used as well.

The coupling unit 141 of the stopper 140 may be provided with an elastic member connecting unit 142 to which one end of the elastic member 150 is coupled, and the lower wall 149 of the ice-making compartment may be provided with an elastic member connecting unit 149*a* to which the other end of the elastic member 150 is coupled. Accordingly, the stopper 140 may be elastically coupled to the lower wall 149 of the ice-making compartment by use of the elastic member 150.

As described above, as a portion of the stopper 140 is not supported by the lower wall 149 when the stopper 140 is pulled toward the front, the portion that is not supported by the lower wall 149 of the ice-making compartment may move downward due to the weight of that portion and the force of the fixing protrusion 81. That is, the stopper 140 may bend. Accordingly, the fixing protrusion 81 may release from the stopper 140.

As the fixing protrusion 81 is released from the stopper 140, the stopper 140 may be returned to its original position by the elasticity of the elastic member 150.

As is apparent from the various embodiments of the present disclosure, an ice bucket may be easily removed from an ice-making compartment.

Although only some of the embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator, comprising:

a body;

an ice-making compartment inside the body;

an ice-making tray configured to generate ice and being located inside of the ice-making compartment;

an ice bucket configured to store the generated ice and being removable from the ice-making compartment;

a stopper, at a lower portion of the ice-making compartment, configured to restrain a horizontal movement of the ice bucket; and a locker coupled to an upper wall of the body, and comprising a magnet configured to fix the ice bucket in place by magnetic force and an elastic guider to guide a removal of the ice bucket from an installed position which the ice bucket is installed in the ice-making compartment, wherein when the ice bucket is in the installed position, the ice bucket is raised to release the ice bucket from the stopper so that the ice bucket is removed from the ice-making compartment, and in response to the ice bucket being raised, the elastic guider is pushed up from an initial position by the ice bucket being raised to guide the removal of the ice bucket from the inside of the ice-making compartment wherein the elastic guider is not pushed up from the initial position when the ice bucket is within the ice-making compartment or the elastic guider is not pushed up when the ice bucket is not present in the ice-making compartment.

2. The refrigerator of claim 1, wherein the locker further comprises a main support inclinedly formed in an upward direction toward a front of the refrigerator, the magnet is placed in the main support to be supported by the main support, and the elastic guider extends from a lower end of the main support so that elastic guider is flexible about the lower end.

3. The refrigerator of claim 2, wherein the elastic guider comprises an auxiliary support inclinedly formed in an upward direction toward a rear of the refrigerator to support the magnet.

4. The refrigerator of claim 2, wherein the locker comprises an elastic holder to hold the magnet in the main support.

5. The refrigerator of claim 2, wherein the locker comprises an exit preventer at an upper side of the main support to keep the magnet in place in the main support.

6. The refrigerator of claim 5, wherein a gap is formed between the exit preventer and the magnet.

7. The refrigerator of claim 2, wherein the locker comprises a slit around at least a portion of a perimeter of the elastic guider.

8. The refrigerator of claim 1, wherein the elastic guider comprises a stopper to limit a rotational range of the elastic guider.

9. The refrigerator of claim 1, wherein the elastic guider is integrally formed with the locker.

10. The refrigerator of claim 1, wherein the stopper is elastically moved due to the ice bucket when the ice bucket is being removed.

11. A refrigerator, comprising:

a body;

an ice-making compartment, having an opening, inside the body of the refrigerator;

an ice-making tray inside the ice-making compartment, configured to generate ice;

an ice bucket, configured to store the generated ice, attached to or detached from the ice-making compartment, and including a fixing protrusion; and a stopper, at a lower portion of the ice-making compartment, configured to fix the ice bucket by coupling with the fixing protrusion, wherein the stopper, when coupled to the fixing protrusion, is configured to be moved from a first position by the fixing protrusion when the ice bucket is pulled and to return to the first position when the fixing protrusion is uncoupled from to the stopper, and wherein the stopper is configured to move toward a front of the refrigerator when the ice bucket is pulled.

12. The refrigerator of claim 11, wherein the stopper is moved downward by the fixing protrusion to uncouple the fixing protrusion.

13. The refrigerator of claim 12, wherein the ice-making compartment comprises: a lower wall to which the stopper is coupled, and a movement gap between a front end portion of the lower wall of the ice-making compartment and the stopper.

14. The refrigerator of claim 13, wherein the stopper comprises:

a coupler coupled to the lower wall of the ice-making compartment;

an interference configured to couple with the fixing protrusion;

a guide at a front of the interference to guide the fixing protrusion to the interference unit; and a connector bendedly formed substantially in U-shape to connect the coupler to the interference unit.

15. The refrigerator of claim 14, wherein the movement gap is between the connector and the front end portion of the lower wall of the ice-making compartment.

16. The refrigerator of claim 14, wherein the interference is inclinedly formed in an upward direction toward a front of the refrigerator.

17. The refrigerator of claim 11, comprising an elastic member configured to move the stopper to the first position when the fixing protrusion no longer forces the stopper to move by releasing the stopper.

18. The refrigerator of claim 17, wherein the elastic member comprises a coil spring.

19. The refrigerator of claim 11, wherein an upper portion of the ice bucket is provided with a first magnet, and the refrigerator comprises a locker with a second magnet that attracts the first magnet and is coupled to an upper wall of the body.

* * * * *